US012709811B2

(12) United States Patent
Baronia et al.

(10) Patent No.: US 12,709,811 B2
(45) Date of Patent: Aug. 18, 2026

(54) ELECTROCHEMICAL CONVERSION OF CARBON DIOXIDE TO FORM AN ORGANIC ACID

(71) Applicant: UOP LLC, Des Plaines, IL (US)

(72) Inventors: Richa Baronia, Gurugram (IN); Jyoti Goel, Gurugram (IN); Sachin Daulatgir Giri, Gurugram (IN); Sagar Sopan Ghadage, Gurugram (IN); Kuldeep Balram Mamtani, Gurugram (IN)

(73) Assignee: UOP LLC, Rosemont, IL (US)

( * ) Notice: Subject to any disclaimer, the term of this patent is extended or adjusted under 35 U.S.C. 154(b) by 0 days.

(21) Appl. No.: 19/007,096

(22) Filed: Dec. 31, 2024

(65) Prior Publication Data

US 2025/0137144 A1 May 1, 2025

Related U.S. Application Data

(62) Division of application No. 17/568,594, filed on Jan. 4, 2022, now Pat. No. 12,180,600.

(51) Int. Cl.

| | |
|---|---|
| ***C25B 1/04*** | (2021.01) |
| ***C25B 3/07*** | (2021.01) |
| ***C25B 3/23*** | (2021.01) |
| ***C25B 3/26*** | (2021.01) |
| ***C25B 9/17*** | (2021.01) |
| ***C25B 11/032*** | (2021.01) |
| ***C25B 11/042*** | (2021.01) |
| ***C25B 13/00*** | (2006.01) |

(52) U.S. Cl.
CPC ..... *C25B 3/07* (2021.01); *C25B 3/23* (2021.01); *C25B 9/17* (2021.01); *C25B 11/032* (2021.01); *C25B 11/042* (2021.01); *C25B 13/00* (2013.01)

(58) Field of Classification Search
CPC .... C25B 1/04; C25B 3/07; C25B 3/23; C25B 3/26
USPC ..... 205/440, 628
See application file for complete search history.

(56) References Cited

U.S. PATENT DOCUMENTS

2017/0037522 A1* 2/2017 Kaczur ..... B01J 41/14

OTHER PUBLICATIONS

Li et al., "Comparative Techno-Economic and Life Cycle Analysis of Water Oxidation and Hydrogen Oxidation at the Anode in a CO2 Electrolysis to Ethylene System," ACS Sustainable Chemistry & Engineering (Oct. 28, 2021), vol. 9, No. 44, pp. 14678-14689. (Year: 2021).*

* cited by examiner

*Primary Examiner* — Edna Wong
(74) *Attorney, Agent, or Firm* — Paschall & Associates, LLC; Mark Goldberg

(57) ABSTRACT

A process for electrochemical conversion of carbon dioxide using a three-compartment cell provides low voltage requirements, high faradaic efficiencies, and high concentration of formic acid in product solutions. The applied voltage between anode and cathode should be less than 3.5V. Carbon dioxide may be converted to an organic acid.

4 Claims, 10 Drawing Sheets

ELECTROCHEMICAL CONVERSION OF CARBON DIOXIDE TO FORM AN ORGANIC ACID

FIELD

The field is electrochemistry and includes a process for the electrochemical conversion of carbon dioxide to useful products.

BACKGROUND

There is a desire to decrease carbon dioxide ($CO_2$) emissions from industrial facilities and power plants as a way of reducing emission of greenhouse gases and protecting the environment. One solution, known as carbon sequestration, involves the capture and storage of $CO_2$. Often the $CO_2$, is simply buried. It would be beneficial if instead of simply burying or storing the $CO_2$, it could be converted into another product and put to a beneficial use.

Over the years, several electrochemical processes have been suggested for the conversion of $CO_2$ into useful products.

Processes utilizing electrochemical cells for chemical conversions have also been described. Generally, an electrochemical cell contains an anode, a cathode, and an electrolyte. Catalysts can be placed on the anode, the cathode, and/or in the electrolyte to promote the desired chemical reactions. During operation, reactants or a solution containing reactants are fed into the cell. A voltage (potential difference) is then applied between the anode and the cathode, to promote the desired electrochemical reaction.

Formic acid is a chemical product considered as a useful $CO_2$ conversion product. Formic acid is an important industrial chemical with a manufacturing volume of ~1.0 million tons annually. Formic acid is used as a preservative in livestock feed, in leather tanning, and in making fine chemicals. The current commercial process for manufacturing formic acid is from the carbonylation of methanol, in which carbon monoxide and methanol are reacted in the presence of a strong base, such as sodium methoxide. The methyl formate product can then be hydrolyzed by various routes to form formic acid. The formic acid product can then be purified and concentrated by various methods to make commercial formic products for sale. Depending on the hydrolysis process employed, various byproducts, such as ammonium sulfate, can be formed and managed. In this disclosure, an electrochemically efficient method for the conversion of $CO_2$ to formic acid is disclosed.

When an electrochemical cell is used as a $CO_2$ conversion system, a reactant comprising $CO_2$, carbonate or bicarbonate is fed into the cell. A voltage is applied to the cell, and the $CO_2$ reacts to form new chemical compounds.

Several different cell designs have been used for $CO_2$ conversion. Most of the early work used liquid electrolytes between the anode and cathode, while later scientific papers discussed using solid electrolytes.

U.S. Pat. Nos. 4,523,981, 4,545,872 and 4,620,906 disclose the use of a solid polymer electrolyte membrane, typically a cation exchange membrane, in which the anode and cathode are separated by the cation exchange membrane. A liquid electrolyte can be used in contact with a cathode.

Kaczur, et al., describes in U.S. Pat. No. 10,047,446 a method and system for electrochemical production of formic acid from carbon dioxide. Formate ion selectivity is at least 50% in some examples at cell potential of 3V or greater.

Faradaic efficiencies of less than 30% are not practical for commercial use. A process that has a Faradaic efficiency of at least 50%, preferably over 80%, would provide a practical solution at low cell potentials. Furthermore, a device with a low $CO_2$ conversion current is impractical. A process using a three-compartment cell with a $CO_2$ conversion current of at least 25 mA/cm$^2$ would also provide a practical solution.

Thus, there is a need for improved methods for electrochemical conversion of carbon dioxide to useful products, particularly to organic acids.

BRIEF SUMMARY

We have discovered a process for electrochemical conversion of carbon dioxide using a three-compartment cell that provides low voltage requirements, high faradaic efficiencies, and high concentration of formic acid in product solutions. The applied voltage between anode and cathode should be less than 3.5V.

DEFINITIONS

The term "communication" means that fluid flow is operatively permitted between enumerated components, which may be characterized as "fluid communication".

The term "downstream communication" means that at least a portion of fluid flowing to the subject in downstream communication may operatively flow from the object with which it fluidly communicates.

As used herein, the term "predominant" or "predominate" means greater than 50%, suitably greater than 75% and preferably greater than 90%.

As used herein, "electrolyzer" is meant to indicate a device containing a cathode (negative charge), an anode (positive charge) and a membrane. The entire system may also contain pumps, vents, storage tanks, a power supply, separator and/or other components. Typically, these devices are used to cause an electrochemical reaction such as water electrolysis within the cell stacks of the electrolyzer unit. Electricity is applied to the anode and cathode across the membrane which for the case of water electrolysis causes the water to split into its component molecules, hydrogen ($H_2$) and oxygen ($O_2$).

As used herein, "Faradaic Efficiency" is defined as the ratio between the actual and theoretical maximum amount of electrons converted to products. Faraday efficiency describes the efficiency with which charge (electrons) is transferred in a system facilitating an electrochemical reaction. Electrons used for participation in unwanted side reactions are counted as Faradaic losses.

The term "cathode" means an electrode through which the conventional current exits from a polarized electrical device and electrons flow in from an outside or external circuit connected to the cell. Reduction reactions occur at the cathode.

The term "anode" means an electrode through which the conventional current enters into a polarized electrical device and electrons flow out into an outside or external circuit connected to the cell. Oxidation reactions occur at the anode.

DETAILED DESCRIPTION

The disclosure provides a process for electrochemically converting carbon dioxide to at least one organic acid. Three-compartment electrochemical cells may be used to convert carbon dioxide at a cathode to formate and the formic acid recovered.

Figure 1:
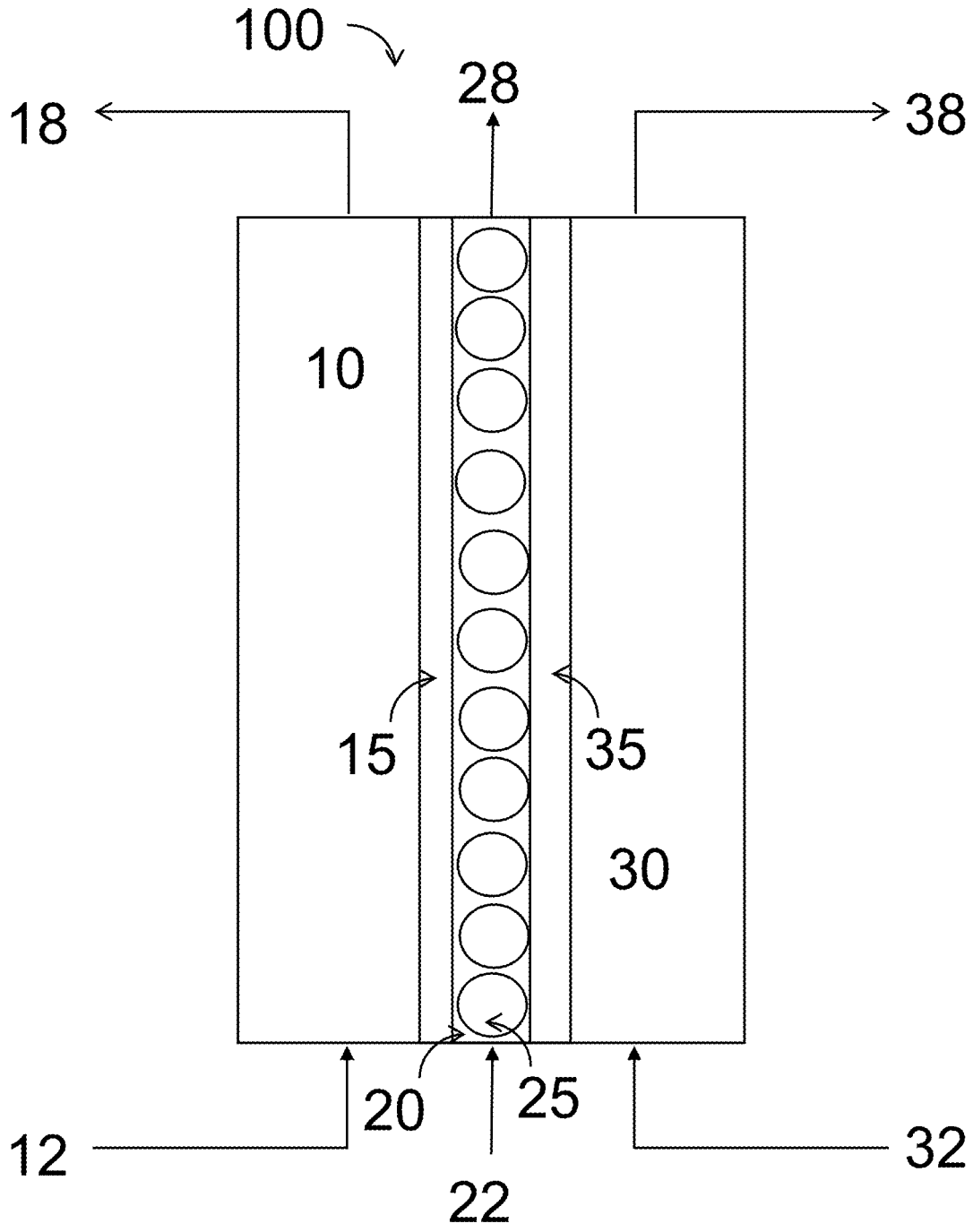
FIG. 1 is a schematic elevational drawing of a process of the present disclosure.

FIG. 1 shows a schematic elevational drawing of a process of the present disclosure. A three-compartment electrochemical cell 100 may be used in the process of the instant disclosure. In an exemplary embodiment, an anode reactant in line 12 comprising hydrogen may be fed to an anode 10 comprising a quantity of anode catalyst dispersed on or throughout a gas diffusion electrode used as the anode 10. The anode reactant in line 12 may comprise hydrogen. At the anode, an anodic oxidation reaction may occur, such as the oxidation of hydrogen to $H^+$ ions. Hydrogen, as an element, has a formal charge of 0. Protons have a charge of 1+, so in the oxidation of hydrogen to protons, a one electron oxidation has occurred. At the anode, anodic oxidation reactions cause the oxidation state of a product to be increased from that of the reactant.

The anode reactant may be pure hydrogen with a flow rate of 10 mL/min to 20 mL/min. Hydrogen may be diluted with inert gasses in the anode reactant. Preferably, the anode reactant is predominantly hydrogen. The anode catalyst may be platinum loaded on Toray carbon. Platinum loading may vary from 0.1 mg/cm$^2$ to 1 mg/cm$^2$.

A cation exchange membrane 15 can be positioned between the anode 10 and the central flow compartment 20. A range of cation exchange membranes may be utilized in the disclosure. A preferred cation exchange membrane is that sold by Chemours (formerly DuPont) as Nafion 115 membranes, which are non-reinforced films based on chemically stabilized perfluorosulfonic acid/PTFE copolymer in the acid ($H^+$) form. H+ ions (protons) formed at the anode may pass through the cation exchange membrane 15 into the central flow compartment 20. An anode product stream in line 18 may be recovered for recycle as a portion of the anode reactant stream in line 12 or exhausted from the process. The anode product stream in line 18 may comprise hydrogen.

The central flow compartment 20 may preferably contain macroreticular resin 25. The macroreticular resin 25 may comprise an ion-exchange resin in bead form. The preferable macroreticular resin 25 would help promote the transport of $H^+$ ions as well as the formate ions in the formation of formic acid, as well as providing a suitable ionic conductivity in the central flow compartment to reduce the voltage drop of the compartment. The average diameter of the macroreticular resin may greater than about 120% of and less than about 170% of the width of the void space in central flow compartment 20. Resin dimensions greater than the width of the void space are preferred. Rubbery/compressible anion exchange membranes form a boundary of the central flow compartment 20, hence part of the "extra" (i.e. >100%) resin dimension is "accommodated" by the membrane dimensions when compressed in the assembled three compartment cell. Average macroreticular resin diameter of greater than about 120% of and less than about 170% of the width of the void space in central flow compartment 20 may lead to a preferred scenario due to "flat" and "uniform" contact between resin, membranes and catalysts. Improved current density and stability may be an outcome of these resin dimensions. The macroreticular resin 25 may form a single layer within said void space.

A cathode reactant in line 32 comprising carbon dioxide may be fed to a cathode 30 comprising a quantity of cathode catalyst dispersed on or throughout a gas diffusion electrode used as the cathode 30. The cathode reactant in line 32 may comprise carbon dioxide. At the cathode, a cathodic reduction reaction may occur, such as the reduction of carbon dioxide to formate ions. Carbon dioxide is the most oxidized form of carbon and has a formal charge of 0. Formate has a charge of −1, so in the reduction of carbon dioxide to formate, a one electron reduction has occurred. At the cathode, cathodic reduction reactions cause the oxidation state of a product to be decreased from that of the reactant.

The cathode catalyst on cathode 30 may comprise a metal selected from the group consisting of Au, Ag, Cu, Sn, Sb, Bi, Pb, Zn and In and combinations thereof. The metal may comprise Sn and Bi. An exemplary source of Bi may be $Bi_2O_3$. The ratio of $Bi_2O_3$ to Sn may be 8 to 2 by weight. The cathode catalyst may be manufactured by drop casting or spray coating. In either method, a source of metal or metals in liquid or slurry form is contacted with a catalyst support. Drop casting may involve the formation of a thin solid film by dropping a solution or slurry onto a flat surface followed by evaporation of the solution/slurry. Spray coating may involve spraying finely dispersed droplets of the solution/slurry onto a surface and evaporation of the solution/slurry to form a solid coated surface. The catalyst support comprising cathode 30 may comprise carbon. Conductive carbons such as carbon papers, including those sold by Toray, or carbon powders, such as those sold by Cabot under the Vulcan™ brand, may be suitable catalyst supports. The temperature for drop casting to form the cathode catalyst may be in the range of from about 30° C. to about 40° C.

The formate ion selectivity may at least 50% at a cell potential difference of about 2.2 V. Formate ion selectivity at the cathode 30 may be greater than 50% or greater than 55% or greater than 60% at cell potential difference in the range of from about 2V to about 3.5V. A cathode product stream may be recovered in line 38. The cathode product stream may comprise unreacted $CO_2$, CO and $H_2$. The cathode product stream may be predominantly carbon dioxide. Preferably, carbon monoxide comprises less than 1 wt % or about 0.1 wt % or less than about 0.01 wt % of the cathode product stream. The cathode product stream may further comprise formate. Preferably, formate comprises less than 1 wt % or about 0.1 wt % or less than about 0.01 wt % of the cathode product stream.

An anion exchange membrane 35 can be directly positioned between a gas diffusion electrode (GDE) used as the cathode 30 and the central flow compartment 20. A range of anion exchange membranes may be utilized. Suitable anion exchange membranes may include those sold as: Sustainion (Dioxide Materials), Acmion (Ionomr), Pention (Xergy), AMI-7001 (Membranes International Inc), Orion (Orion Polymers) and Guo (Guo Chu Technology). The anion exchange membrane 35 may preferentially comprise a KOH treated polybenzimidazolium membrane. The anion exchange membrane, which does not permit the bulk flow of liquid to the cathode 30, may provide that the cathode does not flood under the aqueous liquid hydrostatic pressure of the aqueous formic acid solution formed in the central flow compartment 20.

The anion exchange membrane 35 can allow for the transport of the formate ions generated by the cathode catalyst in the cathode 30 through the membrane 35 and into the central flow compartment 20. The average current density at the anion exchange membrane 35 is at least about 20 $mA/cm^2$, wherein the area in the denominator of the current density is the area of the cathode gas diffusion electrode on which the catalyst is disposed.

An inlet solution feed in line 22 comprising water may be fed to a central flow compartment 20 wherein the central flow compartment comprises macroreticular resin 25 dispersed within void space of the central compartment 20. The flow rate of the inlet solution feed may be from about 0.05 to 1 mL/minute. The inlet solution may be deionized water at neutral pH. The inlet solution may have a pH of between about 6 or about 6.5 or about 6.8 and about 8 or about 7.5 or about 7.2.

The central flow compartment 20 can be a region comprising void space bounded by a cation exchange membrane 15 forming the boundary of the anode 10 of the cell on one side and an anion exchange membrane 35 on the other side forming the boundary of the cathode 30 of the three-compartment cell 100. In the central flow compartment 20, aqueous formic acid is formed from the ionic combination of the hydrogen ions ($H^+$) generated in the anode 10, passing through the anode side cation exchange membrane 15, and formate ions generated at the cathode 30, passing through the cathode side anion exchange membrane 35.

A product solution in line 28 comprising formic acid may be recovered from an outlet of the central flow compartment 20. The product solution may comprise an aqueous solution of formic acid. The concentration of formic acid in the aqueous product solution in line 28 may be greater than about 5 wt % or greater than about 7 wt % or greater than about 9 wt % or less than about 50 wt %.

A voltage of from about 1.5V to about 5V may be applied between the anode and cathode. Lower applied voltages are preferable. A voltage of less than about 3.5V may be applied between the anode and cathode.

In an embodiment, the Faradaic Efficiency for formate may be greater than 50%. The Faradaic Efficiency for the formation of formate ($FE_f$) is determined by the Equation: $FE_f = n_{formate} * n\ F/I$ where $n_{formate}$ is the moles of the formate produced per unit time; n represents the moles of electrons per mole of formic acid, F is Faraday's constant, and I is the total current. The Faradaic Efficiency of the process may be greater than about 70%.

Additional process parameters may be important to operating at high efficiency. The unitless ratio of anode reactant flow to cathode reactant flow may be in the range of about 0.5 to about 1.5.

Figure 2:
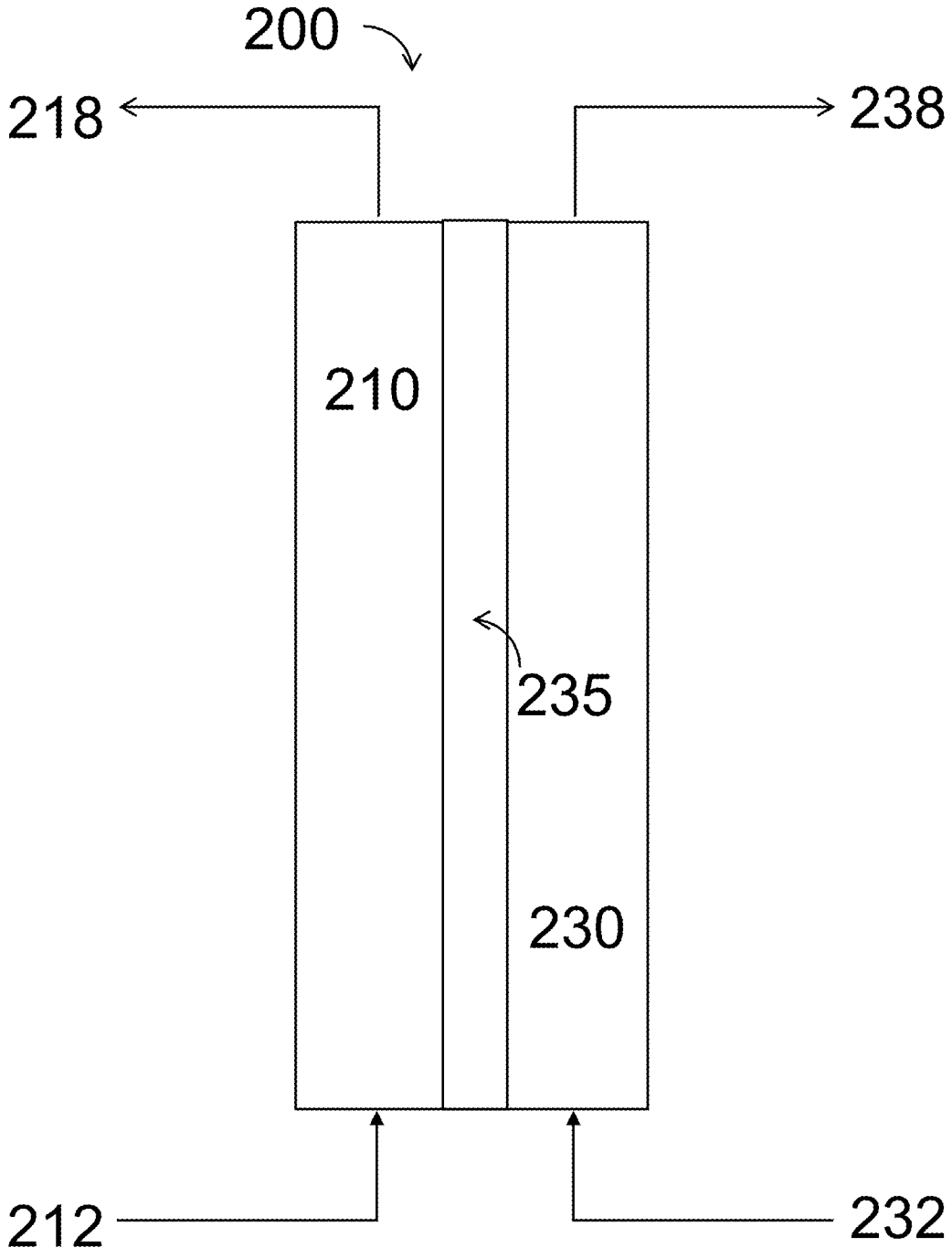
FIG. 2 is a schematic elevational drawing of an alternate process of the present disclosure.

In an embodiment, the anode reactant stream comprising hydrogen in line 12 in FIG. 1 may be generated in an electrolyzer unit 200 as shown in FIG. 2. An electrolyzer cathode reactant in line 232 may be fed to the electrolyzer cathode 230 which may comprise an electrolyzer cathode catalyst. The electrolyzer cathode catalyst may comprise Pt. The electrolyzer cathode catalyst may comprise Pt loaded on carbon. Loadings of Pt on C may range from about 0.1 $mg/cm^2$ to about 1 $mg/cm^2$. The electrolyzer cathode reactant may comprise an aqueous KOH solution. The concentration of KOH in the electrolyzer cathode reactant may range from about 0.1M to about 1.5M. A first electrolyzed product stream in line 238 may be recovered and fed to the three-compartment cell 100 as all or a portion of the anode reactant stream in line 12. An electrolyzer anode reactant in line 212 may be fed to the electrolyzer anode 210.

The electrolyzer anode reactant may comprise water and may further comprise an aqueous KOH solution. KOH may be a preferred component of the electrolyzer anode reactant due to high conductivity. Other electrolytes such as $KHCO_3$, $K_2SO_4$, and KCl may also be used. The concentration of KOH in the electrolyzer anode reactant may range from about 0.1M to about 1.5M. Current density at the anode may be related to the concentration of KOH in the electrolyzer anode reactant, with higher current densities achieved at higher concentration of KOH.

A second electrolyzed product stream in line 218 may be recovered. The electrolyzer may further comprise an anion exchange membrane 235. A range of anion exchange membranes may be utilized. Suitable anion exchange membranes may include those sold as: Sustainion (Dioxide Materials), Acmion (Ionomr), Pention (Xergy), AMI-7001 (Membranes International Inc), Orion (Orion Polymers) and Guo (Guo Chu Technology). The anion exchange membrane may be Sustanion. A voltage of from about 1.5V to about 5V may be applied between the electrolyzer anode 210 and the electrolyzer cathode 230. Lower applied voltages are preferable. A voltage of less than about 2V may be applied between the electrolyzer anode and electrolyzer cathode.

The first electrolyzed product stream in line 238 may comprise hydrogen and may further comprise an aqueous KOH solution. The first electrolyzed product stream may predominantly comprise hydrogen. The first electrolyzed product stream may comprise greater than 95% hydrogen, or greater than 98% hydrogen, or greater than 99% hydrogen. The first electrolyzed product stream may comprise nearly 100% hydrogen, such as 99.9% hydrogen. The second electrolyzed product stream in line 218 may comprise oxygen. The second electrolyzed product stream may predominantly comprise oxygen. Oxygen may be a valuable product and recovered for use as feed to a fuel cell for power generation or medical purpose or other industrial applications.

In an embodiment, the electrolyzer anode reactant in line 212 may comprise ethanol. The electrolyzer anode reactant may also comprise water. Ethanol in the electrolyzer anode reactant may be less than 30 wt %, or less than 25 wt % or less than 20 wt %. The electrolyzer anode reactant may further comprise KOH. KOH may be present in the electrolyzer anode reactant at concentrations of from about 0.1 M to about 3 M. The second electrolyzed product stream in line 218 may comprise acetic acid, ethanol, and/or KOH. The Faradaic Efficiency for acetic acid produced from ethanol oxidation at anode 210 may be greater than 98%.

EXAMPLES

Example 1

Cathode GDE Preparation: Cathode GDE was prepared by using either drop casting catalyst ink on carbon paper or spray coating it on carbon paper. Catalyst ink was prepared by dispersing metal oxides and carbon powder (Vulcan XC 72R) in a ratio of 70:30 by weight. Metal oxides consist of a mixture of bismuth oxide ($Bi_2O_3$) 80 wt % and Tin (Sn) 20 wt %. Commercial Sustainion ionomer was added in the suspension with 2.5 wt % of metal oxide loading. Drop casting/spray coating was carried out at 35° C. to obtain a final metal oxide loading of 4 mg/cm$^2$.

Anode GDE: Commercial GDE purchased from Sainergy Fuel Cell India Pvt. Ltd. has been used in this work. Generally, 20 wt % platinum supported on Vulcan XC 72R carbon powder has been spray coated in carbon paper. Net platinum loading was 0.5 mg/cm$^2$.

Membrane Activation: Cation exchange membrane (CEM) used in this work was commercial Nafion 115. Nafion 115 was activated by soaking Nafion 115 piece of required size in deionized water overnight.

Anion exchange membrane (AEM) used in this work are described in Example 2 and compared to other anion exchange membranes in Example 3.

Center Compartment: Center compartment sandwiched between CEM and AEM was of 0.5 mm thickness made of polymer sheet. Center compartment has an open area of 5 cm$^2$ overlapping the active area of the flow field and which was filled with Amberlyst 36 resin beads of size greater than 0.7 mm and less than 0.8 mm.

Three Compartment Cell Assembly: Assembling of three compartment cell started placing cathode side gasket and then placing cathode GDE on active area of flow field of cathode plate. AEM was place on cathode GDE. Center compartment was then placed on AEM and filled to resin beads to form a single layer of these beads in center compartment. Nafion 115 membrane was placed on center compartment on which anode gasket was place. Anode GDE was then placed on active area. Finally, anode flow field was placed on the assembly.

Example 2

Preparation of anion exchange KOH modified PBI membranes of the instant disclosure utilized commercial PBI-based Celtec membranes from BASF, Germany. Due to their phosphoric acid functionalities, these membranes as received function as cation exchange membranes (CEMs). We soaked these membranes (cut as 4 cm×4 cm pieces) in deionized water for at least 3 h. The objective of soaking was to remove the phosphoric acid species from the membranes. These soaked membranes were then removed from deionized water and soaked in 6 M KOH (typically 14 pieces in 200 mL) for at least 48 h. This step essentially converts these CEMs to anion exchange membranes (AEMs). These in-house modified AEMs (called KOH-doped PBI) were tested for electrochemical experiments.

Example 3

We compared the electrochemical performance of the anion exchange membranes of Example 2 with several commercial AEMs such as Sustainion (Dioxide Materials), Aemion (Ionomr), Pention (Xergy), AMI-7001 (Membranes International Inc), Orion (Orion Polymers) and Guo (Guo Chu Technology). Electrochemical results suggest that our in-house developed KOH-doped PBI outperforms these commercial AEMs. Current density, formic acid Faradaic efficiency and overall stability were significantly improved when our in-house developed KOH-doped PBI was used as the AEM. Our in-house developed KOH-doped PBI had superior mechanical properties and higher ionic conductivity than the other commercial AEMs. Furthermore, unlike other commercial AEMs, our in-house developed PBI did not have batch to batch variability concerns. The results using KOH-doped PBI were found to be extremely reproducible and reliable.

PBI sourced from Fumatech exhibited significantly poor electrochemical performance when compared with the one sourced from BASF. Without being limited by theory, this difference may be due to the fact that PBI from BASF is far more porous and in a swollen ("activated") state due to the presence of phosphoric acid functionalities in it. Membrane mechanical properties, density, membrane composition and method of casting preparation are also different in the two cases.

Example 4

Cathode GDE Preparation: Commercial GDE purchased from Sainergy Fuel Cell India Pvt. Ltd. has been used in this work. Generally, 20 wt % platinum supported on Vulcan XC 72R carbon powder has been spray coated in carbon paper. Net platinum loading was 0.5 mg/cm$^2$.

Anode GDE: Anode GDE was prepared by spray coating commercial nickel oxide powder (NiO) supplied by Sigma Aldrich on carbon cloth.

Membrane Activation: Sustainion AEM was active by placing membrane sheet in 1 M KOH solution for 48 hours at room temperature. A piece of required size was then chopped from the sheet to carry out experiment.

Example 5

Figure 3:
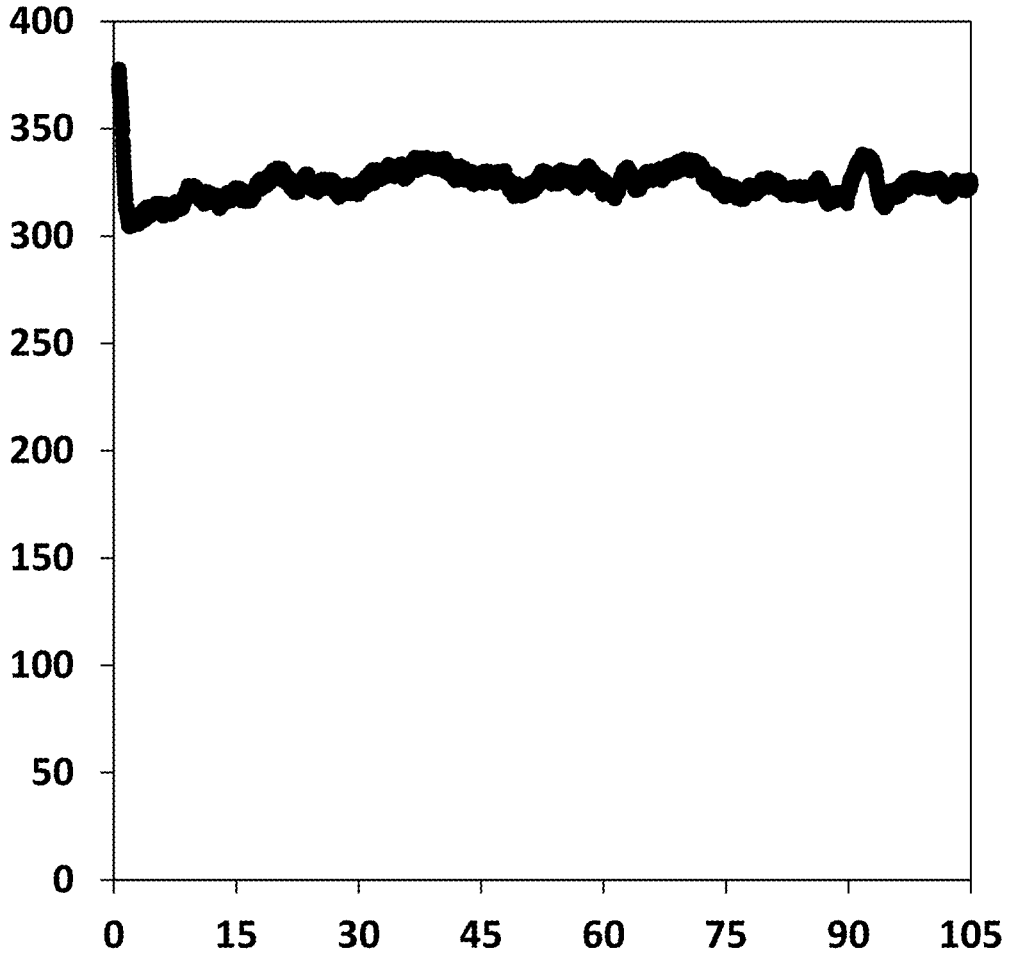
FIG. 3 is a plot of the current density achieved in mA/cm$^2$ as a function of the hours on stream of an experiment described in Example 5.

The current density profile achieved in mA/cm$^2$ as a function of time on stream for electrochemical reduction of $CO_2$ to formic acid in three compartment cell at potential applied of 2.25 V is shown in FIG. 3. A device constructed as described in Examples 1 and 2 was used. A constant current density of 325 to 340 mA/cm$^2$ has been observed for 105 hours run.

Figure 4:
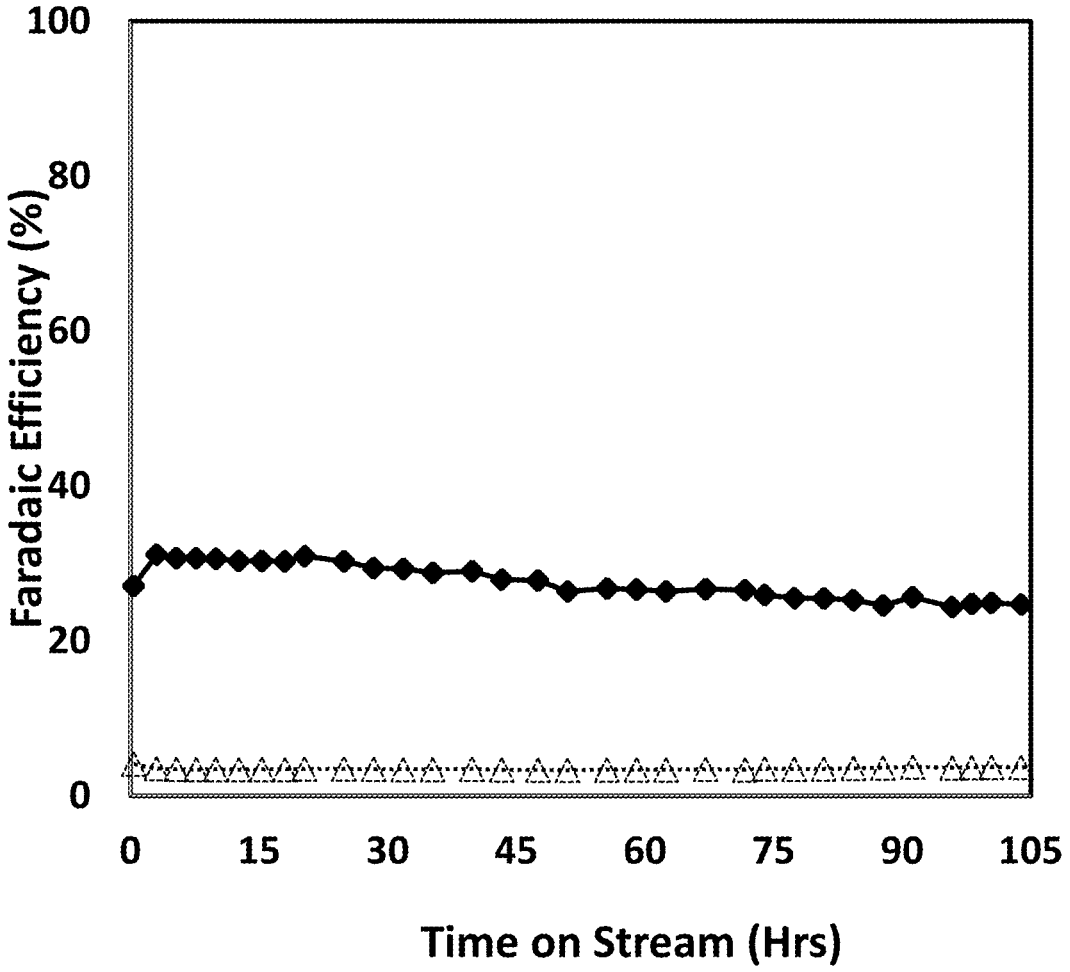
FIG. 4 is a plot of the Faradaic Efficiency (FE) as a function of the hours on stream of an experiment described in Example 5. Dark diamonds are the FE for hydrogen, open triangles for carbon monoxide.

Faradaic efficiency (FE) for gaseous products (hydrogen and carbon monoxide) produced at cathode during electrochemical reduction of $CO_2$ to formic acid is shown in FIG. 4. Dark diamonds are the FE for hydrogen, open triangles for carbon monoxide. A device constructed as described in Examples 1 and 2 was used with an applied potential of 2.25V. FE for carbon monoxide is less than 5% during run. FE for hydrogen is initially close to 30% and decreases with time. These gaseous products are byproducts of the process and comes out from electrolyzer along with unreacted $CO_2$.

Figure 5:
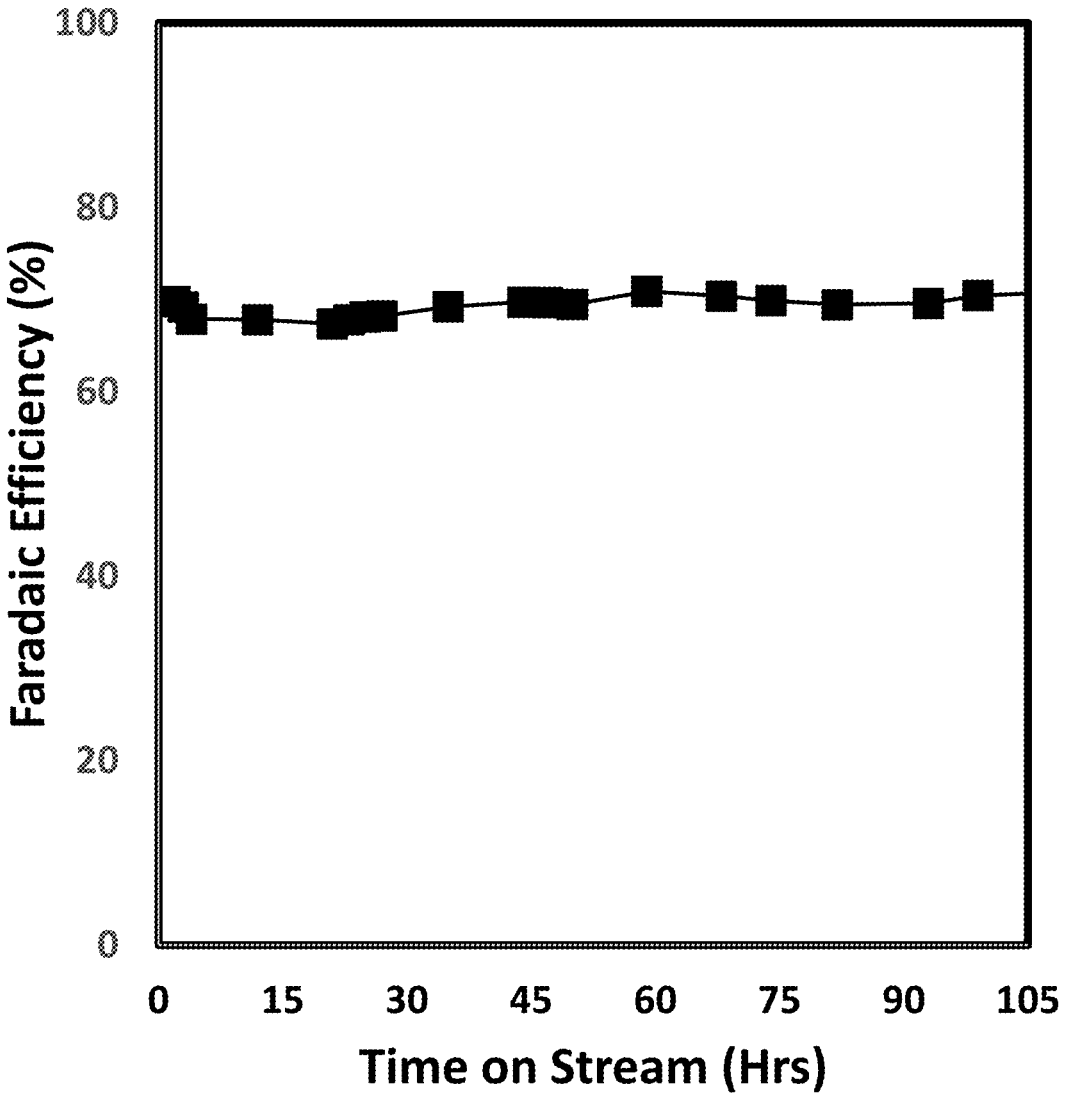
FIG. 5 is a plot of the Faradaic Efficiency (FE) as a function of the hours on stream of an experiment described in Example 5. Dark squares are the FE for formic acid formation.

Faradaic efficiency for formic acid during a run of 105 hours is shown in FIG. 5. Dark squares are the FE for formic acid formation. A device constructed as described in Examples 1 and 2 was used with an applied voltage of 2.25V. FE equal to or greater than 70% has been observed at a 0.05 mL/min flow rate of deionized water in center compartment of three compartment electrochemical cell.

Figure 6:
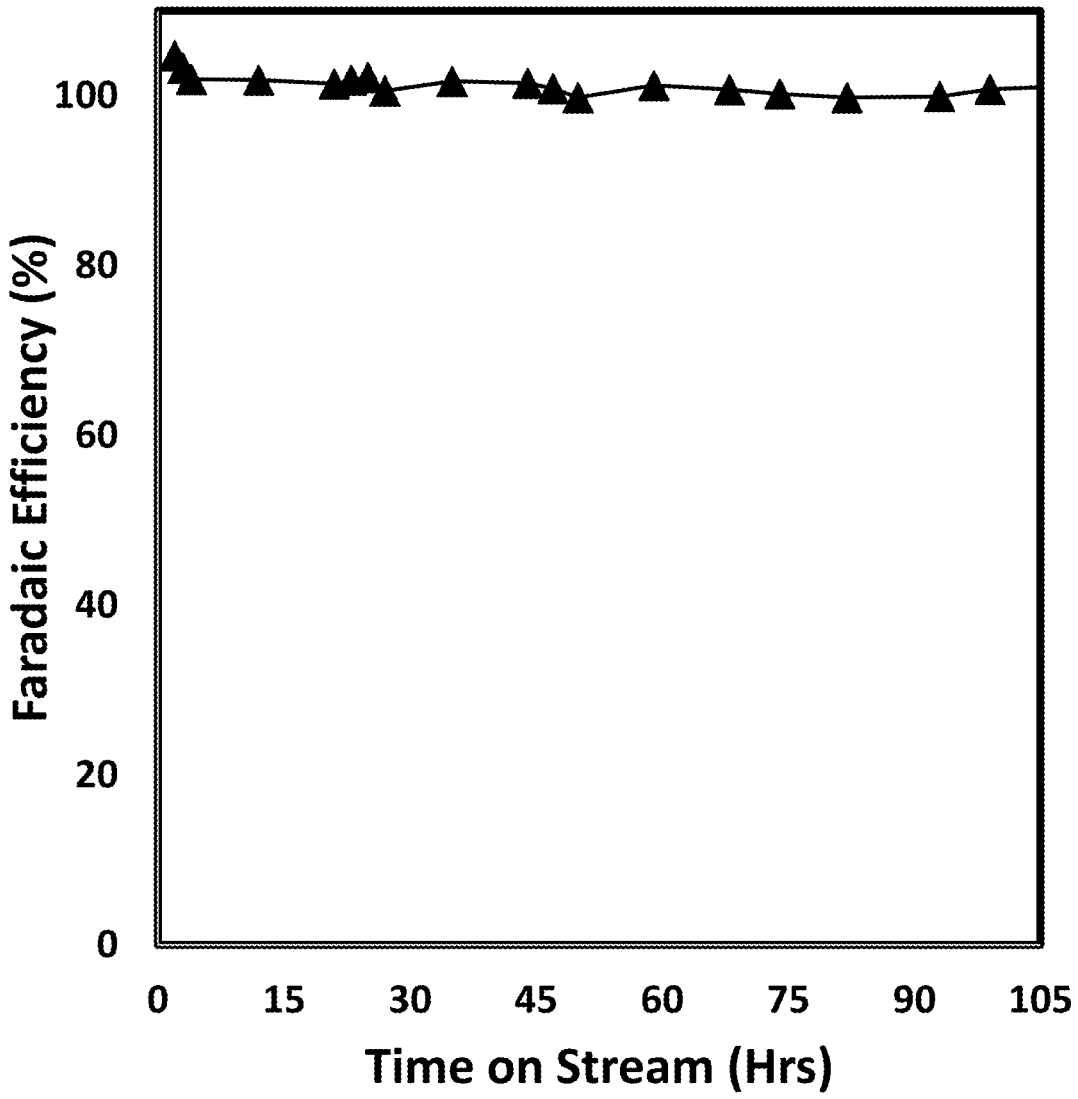
FIG. 6 is a plot of the Faradaic Efficiency (FE) as a function of the hours on stream of an experiment described in Example 5. Dark triangles are the total FE for product formation.

Total FE for all three products is shown in FIG. 6. Dark triangles are the total FE for all products formation. A device constructed as described in Examples 1 and 2 was used with an applied voltage of 2.25V. Total FE sums to 100 during run indicating only the three products shown in FIGS. 4 and 5 are produced at the cathode.

Figure 7:
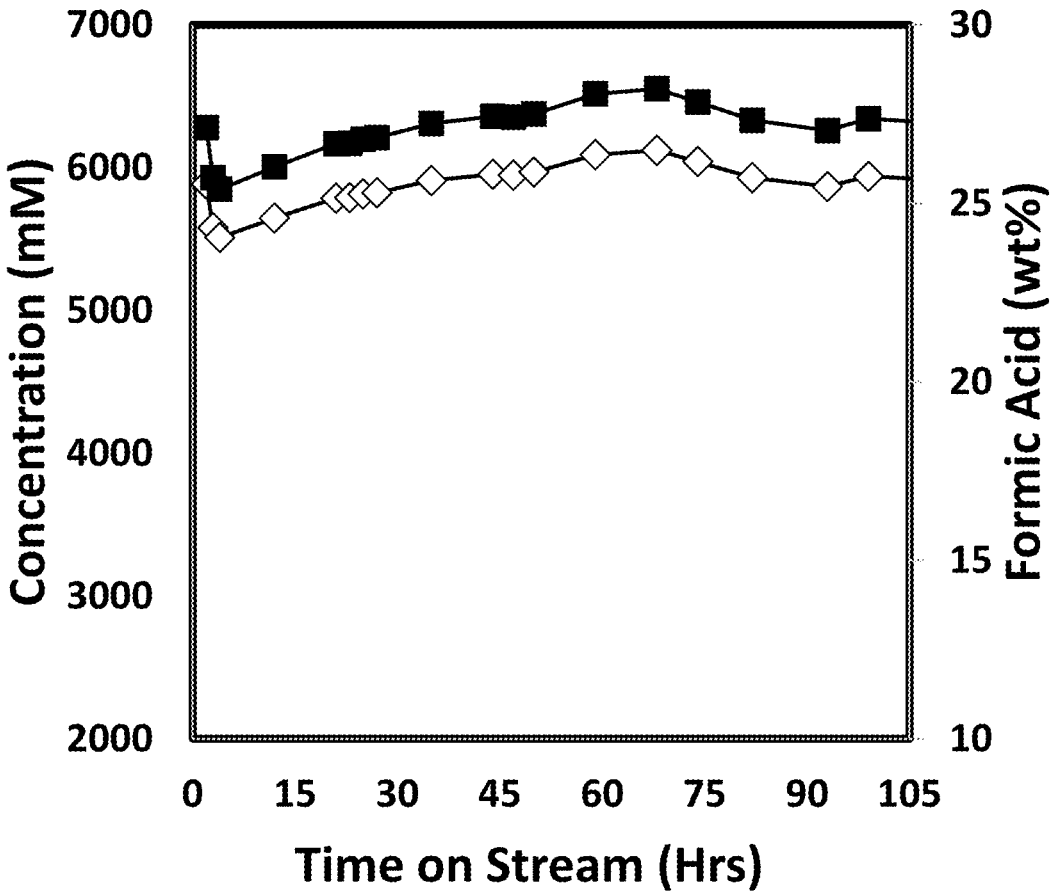
FIG. 7 is a plot of the formic acid concentration in the product stream in mmol/L shown in diamonds filled with gray on the left axis and weight percent of formic acid in the product stream shown as filled squares on the right axis as a function of the hours on stream of an experiment described in Example 5.

Formic acid concentration in outlet of center compartment is shown in FIG. 7 with formic acid concentration in the product stream in mmol/L shown in diamonds filled with gray on the left axis and weight percent of formic acid in the product stream shown as filled squares on the right axis as a function of the hours on stream. A device constructed as described in Examples 1 and 2 was used with an applied voltage of 2.25V. Concentration of formic acid increases with time indicating that increasing FE for formic acid results in higher concentration formic acid in the product stream. An average concentration of formic acid for 105 hours was 27 wt % or 5.9 M.

Figure 8:
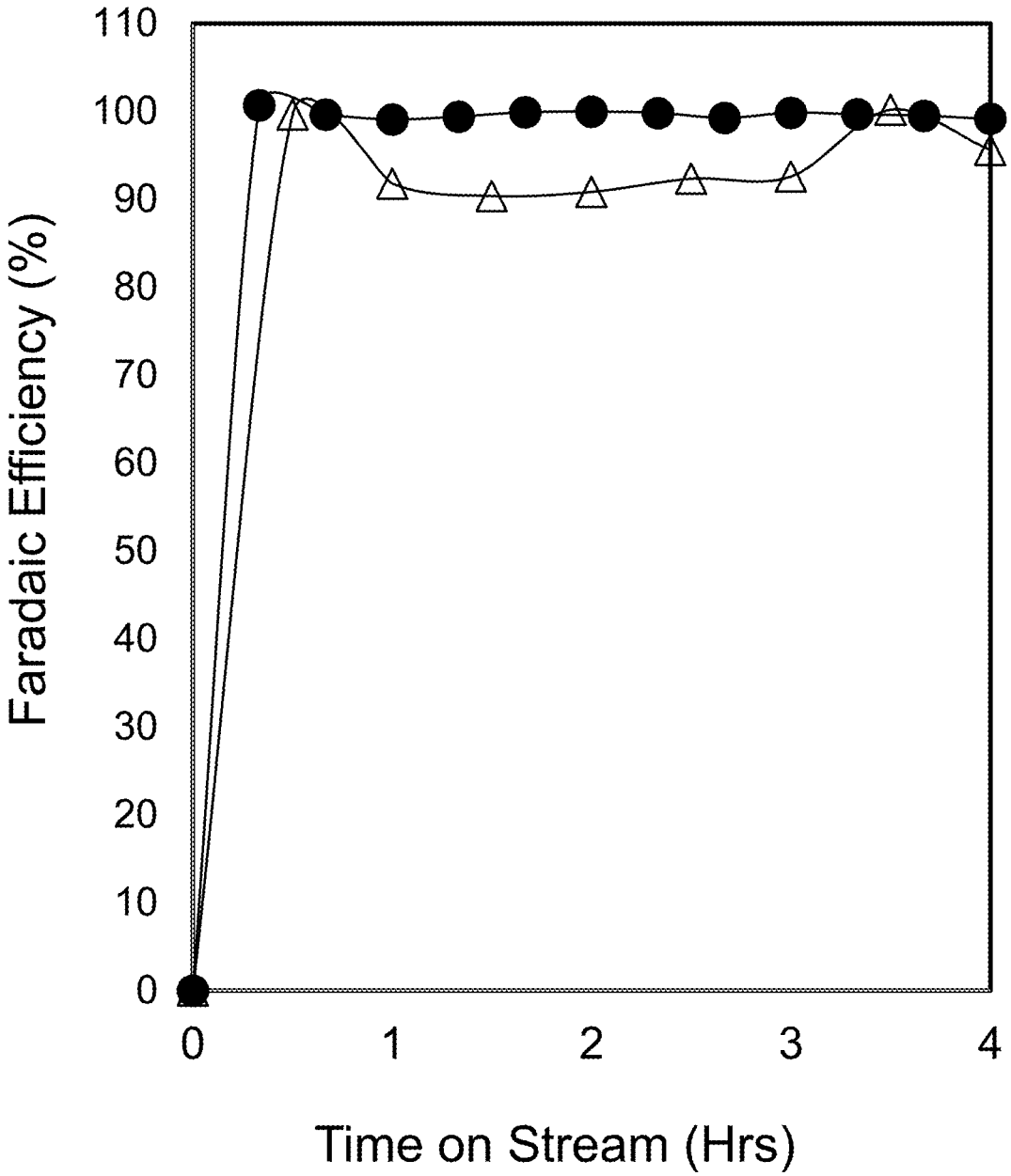
FIG. 8 is a plot of the Faradaic Efficiency (FE) as a function of the hours on stream of an experiment described in Example 5. Filled circles are the FE for hydrogen, open triangles for acetic acid.

The current density for ethanol oxidation to produce acetic acid and hydrogen is shown in FIG. 8. Filled circles are the FE for hydrogen, open triangles for acetic acid. A device constructed as described in Example 4 was used with an applied voltage of 1.8V. A stable current density 100 to 120 $mA/cm^2$ has been observed during run. FE for hydrogen was observed to be 100%. Anode feed was aqueous solution of 1 M ethanol and 0.5 M KOH.

Figure 9:
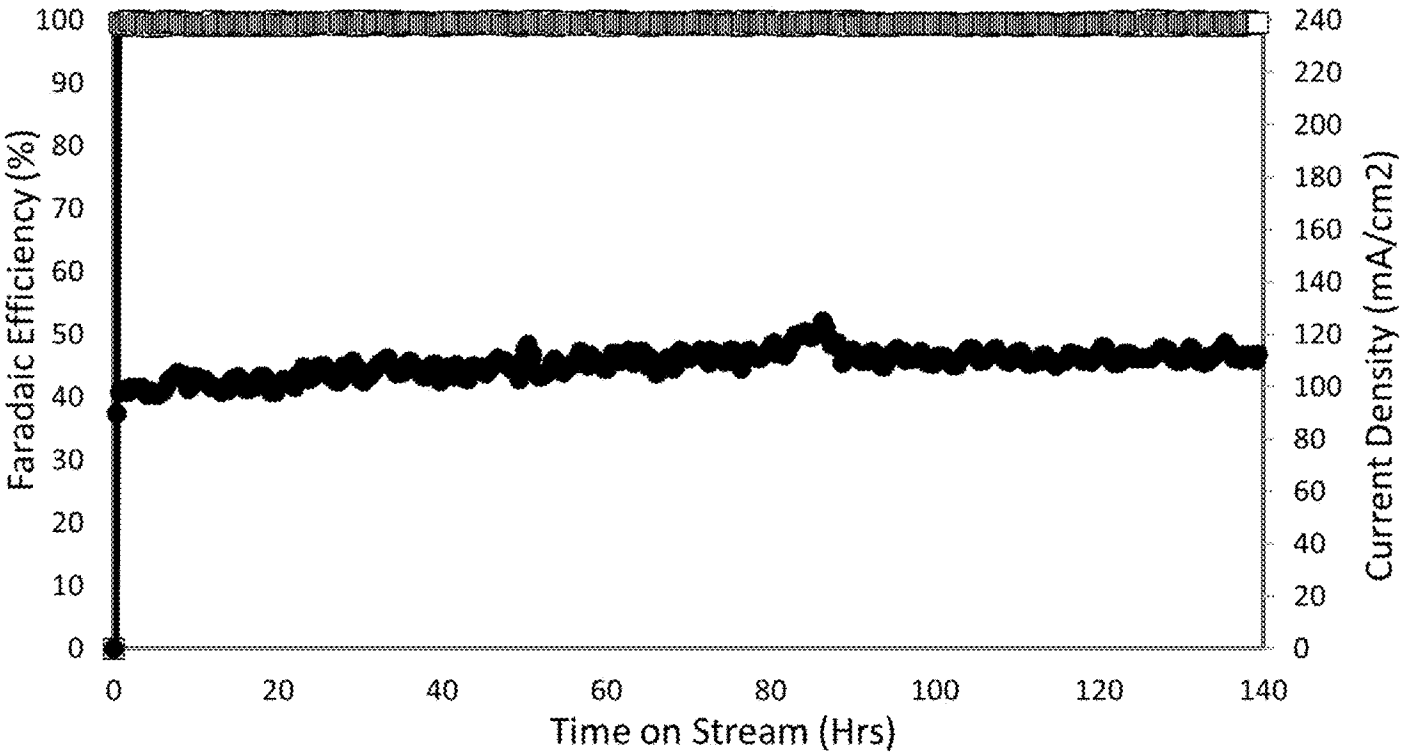
FIG. 9 is a plot of the Faradaic Efficiency (FE) as a function of the hours on stream of an experiment described in Example 5. Open squares (white/black line) are the FE for hydrogen and use the left axis. Current density achieved during the experiment is shown in filled circles (black line) on the right axis in mA/cm$^2$.

FE for acetic acid and hydrogen is shown here is shown in FIG. 9. Open squares (white/black line) are the FE for hydrogen and use the left axis. Current density achieved during the experiment is shown in filled circles (black line) on the right axis in $mA/cm^2$. A device constructed as described in Example 4 was used with an applied voltage of 1.8V. FE for hydrogen equals 100% and FE for acetic acid is greater than 90%.

Figure 10:
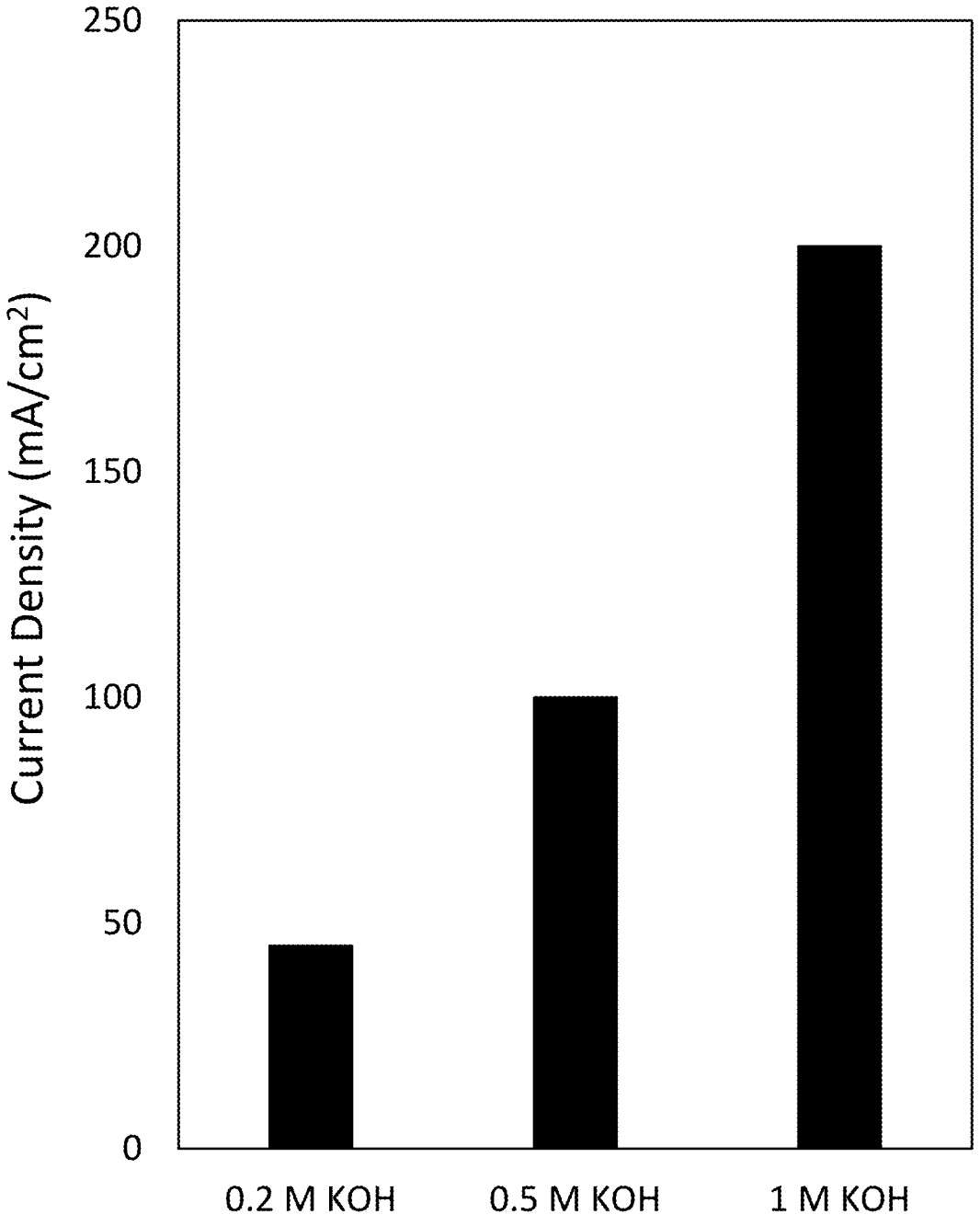
FIG. 10 is a plot of the current density achieved in mA/cm$^2$ as a function of the hours on stream of an experiment described in Example 5. Current density increased as the concentration of KOH in the electrolyzer anode reactant increased.

The effect of KOH concentration in the electrolyzer anode feed is shown in FIG. 10 by plotting the current density achieved in $mA/cm^2$ as a function of the hours on stream. A device constructed as described in Example 4 was used with an applied voltage of 1.8V. Higher concentration of KOH yields increased current density for ethanol oxidation.

While the disclosure has been described with what are presently considered the preferred embodiments, it is to be understood that the disclosure is not limited to the disclosed embodiments, but it is intended to cover various modifications and equivalent arrangements included within the scope of the appended claims.

Specific Embodiments

While the following is described in conjunction with specific embodiments, it will be understood that this description is intended to illustrate and not limit the scope of the preceding description and the appended claims.

A first embodiment of the disclosure is an electrochemical process for carbon dioxide conversion comprising feeding an anode reactant comprising hydrogen to an anode comprising a quantity of anode catalyst; feeding a cathode reactant comprising carbon dioxide to a cathode comprising a quantity of cathode catalyst; feeding an inlet solution feed comprising water to a central flow compartment wherein the central flow compartment comprises macroreticular resin dispersed within a void space; applying a voltage less than about 3.5V between the anode and cathode; and recovering a product solution comprising formic acid from an outlet of the central flow compartment. An embodiment of the disclosure is one, any or all of prior embodiments in this paragraph up through the first embodiment in this paragraph further comprising an anion exchange membrane interposed between the central flow compartment and the cathode, wherein the anion exchange membrane comprises a KOH treated polybenzimidazolium. An embodiment of the disclosure is one, any or all of prior embodiments in this paragraph up through the first embodiment in this paragraph, wherein the cathode catalyst comprises a metal selected from the group consisting of Au, Ag, Cu, Sn, Sb, Bi, Pb, Zn and In and combinations thereof. An embodiment of the disclosure is one, any or all of prior embodiments in this paragraph up through the first embodiment in this paragraph wherein the metal comprises Sn and Bi. An embodiment of the disclosure is one, any or all of prior embodiments in this paragraph up through the first embodiment in this paragraph wherein the concentration of formic acid in the aqueous product solution is greater than about 5 wt %. An embodiment of the disclosure is one, any or all of prior embodiments in this paragraph up through the first embodiment in this paragraph wherein the average current density at the anion exchange membrane is at least about 20 mA/cm2, wherein the area in the denominator of the current density is the area of the cathode gas diffusion electrode on which the catalyst is disposed. An embodiment of the disclosure is one, any or all of prior embodiments in this paragraph up through the first embodiment in this paragraph wherein the formate ion selectivity is at least 50% at a cell potential difference of about 2.2 V. An embodiment of the disclosure is one, any or all of prior embodiments in this paragraph up through the first embodiment in this paragraph wherein the average diameter of the macroreticular resin is greater than about 120% of and less than about 170% of the width of the void space. An embodiment of the disclosure is one, any or all of prior embodiments in this paragraph up through the first embodiment in this paragraph wherein the macroreticular resin forms a single layer within the void space. An embodiment of the disclosure is one, any or all of prior embodiments in this paragraph up through the first embodiment in this paragraph wherein the anode catalyst is free of Ir. An embodiment of the disclosure is one, any or all of prior embodiments in this paragraph up through the first embodiment in this paragraph wherein the Faradaic Efficiency of the process is greater than about 70%. An embodiment of the disclosure is one, any or all of prior embodiments in this paragraph up through the first embodiment in this paragraph wherein the unitless ratio of anode reactant flow to cathode reactant flow is greater than about 0.5 and less than about 1.5. An embodiment of the disclosure is one, any or all of prior embodiments in this paragraph up through the first embodiment in this paragraph wherein the flow rate of the inlet solution feed is about 0.05 ml/min. An embodiment of the disclosure is one, any or all of prior embodiments in this paragraph up through the first embodiment in this paragraph the voltage applied is greater than 2V.

A second embodiment of the disclosure is an electrochemical process for carbon dioxide conversion comprising feeding water to an electrolyzer to generate a first electrolyzed product stream comprising hydrogen and a second electrolyzed product stream comprising oxygen, feeding an anode reactant comprising hydrogen to an anode comprising a quantity of anode catalyst; feeding a cathode reactant comprising carbon dioxide to a cathode comprising a quantity of cathode catalyst; feeding an inlet solution feed comprising water to a central flow compartment wherein the central flow compartment comprises macroreticular resin dispersed within a void space; applying a voltage of and less than about 3.5V between the anode and cathode; and recovering a product solution comprising formic acid from an outlet of the central flow compartment, wherein the first electrolyzed product stream comprises the anode reactant. An embodiment of the disclosure is one, any or all of prior embodiments in this paragraph up through the first embodiment in this paragraph further comprising an anion exchange membrane interposed between the central flow compartment and the cathode, wherein the anion exchange membrane comprises a KOH treated polybenzimidazolium. An embodiment of the disclosure is one, any or all of prior embodiments in this paragraph up through the first embodiment in this paragraph wherein the average current density at the anion exchange membrane is at least about 20 mA/cm2, wherein the area in the denominator of the current density is the area of the cathode gas diffusion electrode on which the catalyst is disposed. An embodiment of the disclosure is one, any or all of prior embodiments in this paragraph up through the first embodiment in this paragraph, wherein the cathode catalyst comprises a metal comprising Sn and Bi. An embodiment of the disclosure is one, any or all of prior embodiments in this paragraph up through the first embodiment in this paragraph wherein the average diameter of the macroreticular resin is greater than about 120% of and less than about 170% of the width of the void space.

A third embodiment of the disclosure is an electrochemical process for carbon dioxide conversion comprising feeding ethanol to an electrolyzer to generate a first electrolyzed product stream comprising hydrogen and a second electrolyzed product stream comprising acetic acid, feeding an anode reactant comprising hydrogen to an anode comprising a quantity of anode catalyst; feeding a cathode reactant comprising carbon dioxide to a cathode comprising a quantity of cathode catalyst; feeding an inlet solution feed comprising water to a central flow compartment wherein the central flow compartment comprises macroreticular resin dispersed within a void space; applying a voltage of and less than about 3.5V between the anode and cathode; and recovering a product solution comprising formic acid from an outlet of the central flow compartment, wherein the first electrolyzed product stream comprises the anode reactant.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the disclosure and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. An electrochemical process for carbon dioxide conversion comprising:

feeding water to an electrolyzer to generate a first electrolyzed product stream comprising hydrogen and a second electrolyzed product stream comprising oxygen, feeding an anode reactant comprising hydrogen to an anode comprising a quantity of anode catalyst;

feeding a cathode reactant comprising carbon dioxide to a cathode comprising a quantity of cathode catalyst;

feeding an inlet solution feed comprising water to a central flow compartment wherein the central flow compartment comprises macroreticular resin dispersed within a void space, and wherein an average diameter of said macroreticular resin is greater than about 120% of and less than about 170% of the width of said void space;

applying a voltage of and less than about 3.5 V between the anode and cathode; and recovering a product solution comprising formic acid from an outlet of said central flow compartment, wherein a concentration of formic acid in an aqueous product solution is greater than about 9 wt % and less than about 50 wt %, wherein said first electrolyzed product stream comprises said anode reactant.

2. The process of claim 1 further comprising an anion exchange membrane interposed between said central flow compartment and said cathode, wherein the anion exchange membrane comprises a KOH treated polybenzimidazolium.

3. The process of claim 2 wherein an average current density at the anion exchange membrane is at least about 20 $mA/cm^2$, wherein the area in the denominator of the average current density is the area of a cathode gas diffusion electrode on which the cathode catalyst is disposed.

4. The process of claim 1, wherein the cathode catalyst comprises a metal comprising Sn and Bi.

* * * * *